US007311230B2

(12) United States Patent
Yeh et al.

(10) Patent No.: US 7,311,230 B2
(45) Date of Patent: Dec. 25, 2007

(54) PAPER-MADE CLOTH HANGER

(76) Inventors: Chi-Yee Yeh, 7F, No. 49, Lane 331. Dexing E. Rd., Shilin Dist, Taipei (TW); Huang Christine, 8F, No. 153, Alley 95, Lane 113, Donghu Rd., Neihu Dist. (TW)

( * ) Notice: Subject to any disclaimer, the term of this patent is extended or adjusted under 35 U.S.C. 154(b) by 516 days.

(21) Appl. No.: 10/948,182

(22) Filed: Sep. 24, 2004

(65) Prior Publication Data

US 2006/0065681 A1 Mar. 30, 2006

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS 5,526,967 A * 6/1996 Kim ..... 223/81
5,952,105 A * 9/1999 Medoff et al. ..... 428/411.1
6,010,044 A * 1/2000 Hsiao ..... 223/85
2003/0161973 A1* 8/2003 Strub ..... 428/22
2005/0058822 A1* 3/2005 Ittel ..... 428/304.4
2006/0054292 A1* 3/2006 Yeh et al. ..... 162/218
2006/0240109 A1* 10/2006 Medoff et al. ..... 424/484

* cited by examiner

*Primary Examiner*—Shaun R. Hurley
(74) *Attorney, Agent, or Firm*—Birch, Stewart, Kolasch & Birch, LLP

(57) ABSTRACT

A hanger is made from non-pure paper pulp with any one or a combination of bamboo, olive palm fiber, hemp and coconut shell that is not usable to make paper. The hangers are made from a paper mold. The hangers further include a hook and a supporting portion, with several fortified indentations on the hook and the supporting portion. A chemical solution is spread on the surface of the whole structure to fortify the surface strength for durable, functional and environment protection purpose.

1 Claim, 4 Drawing Sheets

PAPER-MADE CLOTH HANGER

BACKGROUND OF THE INVENTION

I. Field of the Invention

This invention relates generally to a hanger for cloth or clothing and, more specifically, to a cloth hanger that is made of raw plant fiber pulp, which is not usable to make paper, for durable, functional and environment protection purpose.

II. Description of the Prior Art

Heretofore, it is known that most of the laundry stores use hangers to hang clothing being washed and ironed, so that the clothing is not folded to avoid wrinkles. Referring to FIG. 1, a simple hanger is made of plastic and formed into one body. The shoulder area a1 of the hanger is fortified to avoid cracks during use. The plastic material is waterproof. Since the hangers are delivered along with the clothing to customers, they are considered to be thrown away type products, therefore the hangers must have a low cost and good use advantages. However the thrown away products must meet environment regulations. The recycling process of plastic material requires a high cost.

SUMMARY OF THE INVENTION

It is therefore a primary object of the invention to provide a hanger that is made of raw plant fiber pulp which is not usable for paper for a durable, functional and environment protection purpose.

In order to achieve the objective set forth, a hanger in accordance with the present invention is made of raw plant fiber pulp. The raw pulp is used to make the hangers, which includes a hook and a supporting portion. Several fortified indentations are on the swivel hook and the supporting portion, and a chemical solution is spread on the surface of the whole structure.

Based on above description, the present invention applies non-pure paper pulp with any one or combination of bamboo, olive palm fiber, hemp and coconut shell that is not usable to be made into paper. These material are often thrown away as waste. These materials are ground and made into pulp, and applied to a mold to make hangers. A chemical solution is spread on the surface of the whole structure, which can be water and steam-resist coating or anti-dissolution solution to fortify the surface strength for a durable, functional and environment protection purpose.

BRIEF DESCRIPTION OF THE DRAWINGS

The accomplishment of the above-mentioned object of the present invention will become apparent from the following description and its accompanying drawings which disclose an embodiment of the present invention, and are as follows.

DESCRIPTION OF THE PREFERRED EMBODIMENT

Figure 1:
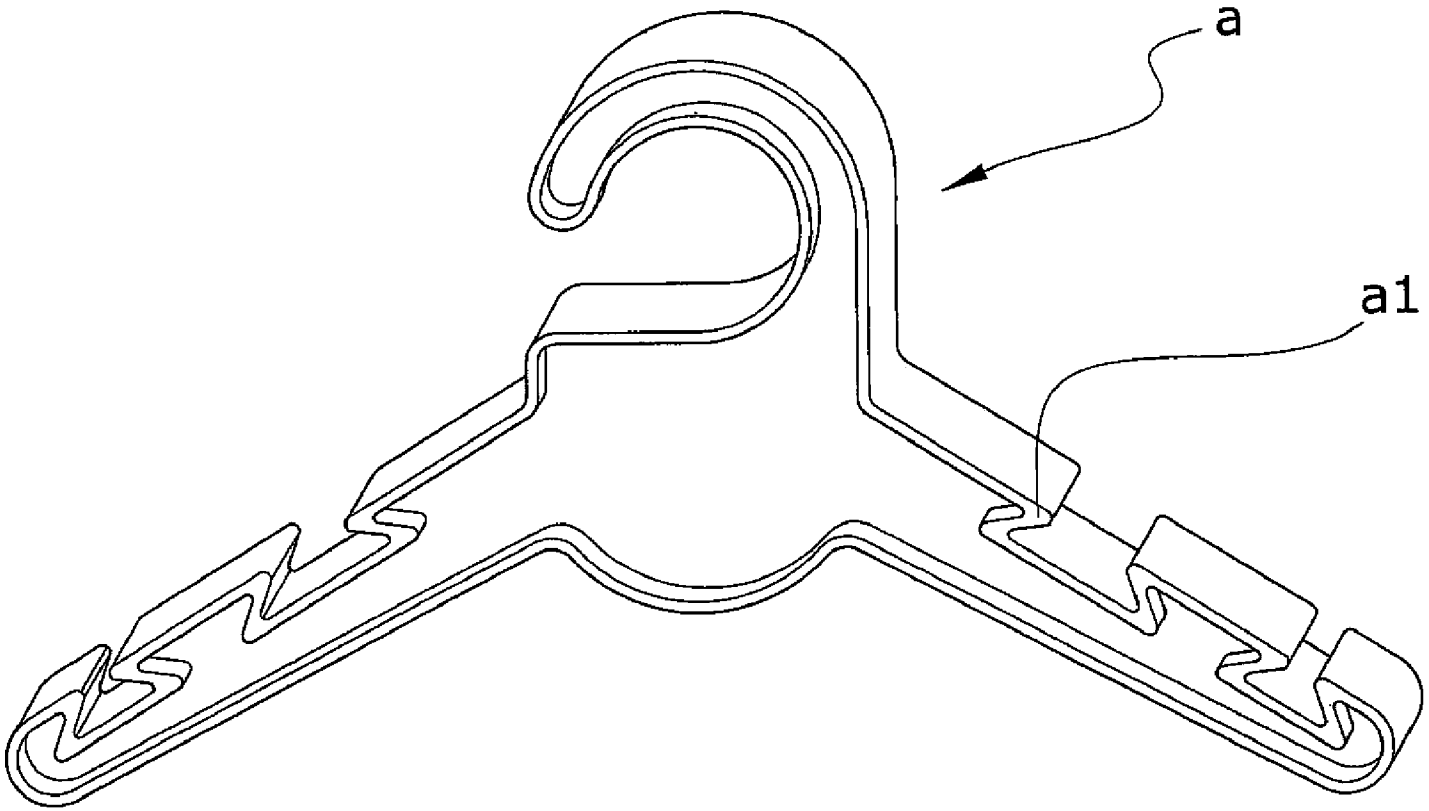
Fig.1 PRIOR ART
FIG. 1 is a perspective view of the prior art.
Figure 2A:
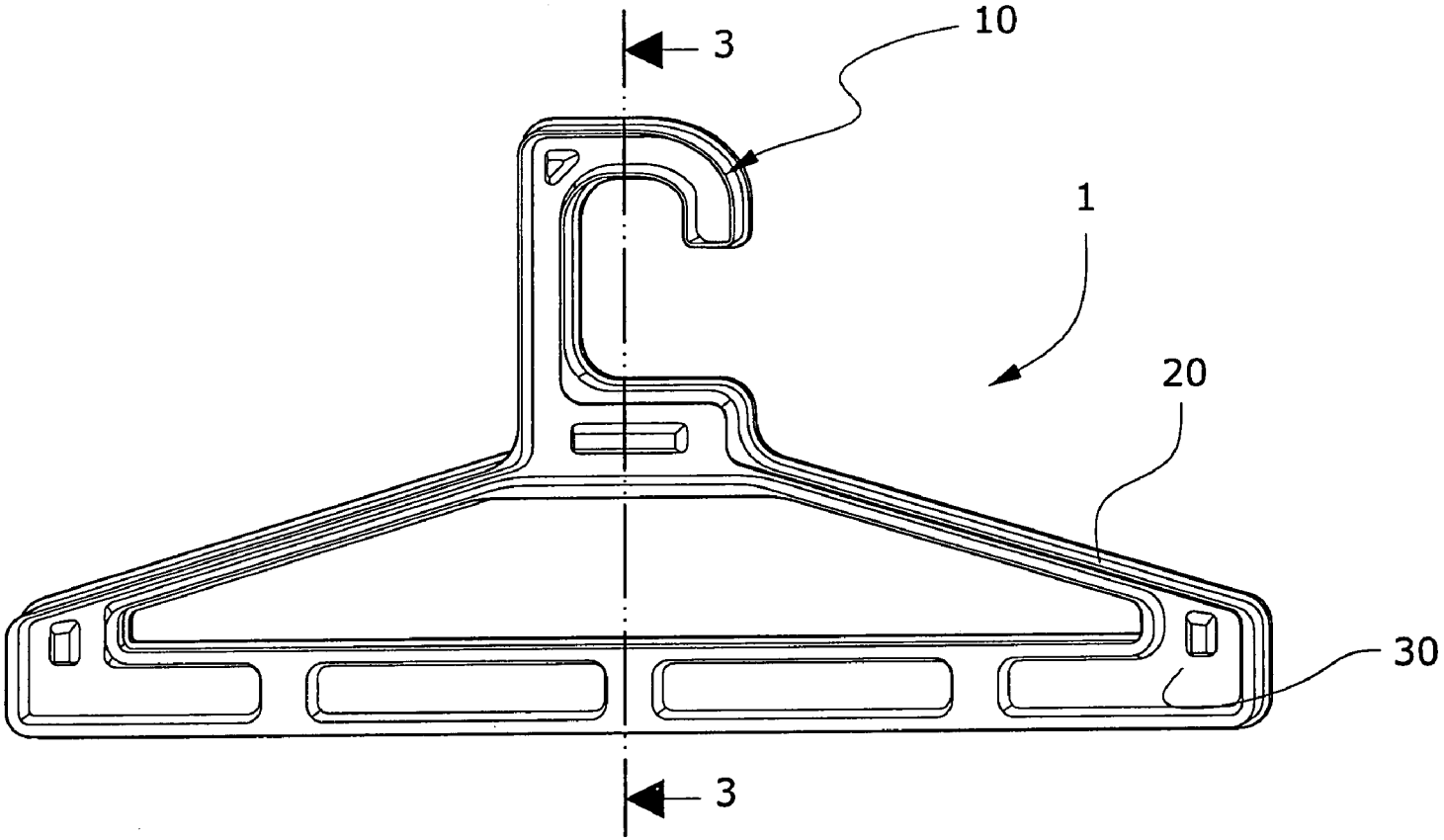
FIG. 2A is a first embodiment of the present invention.
Figure 2B:
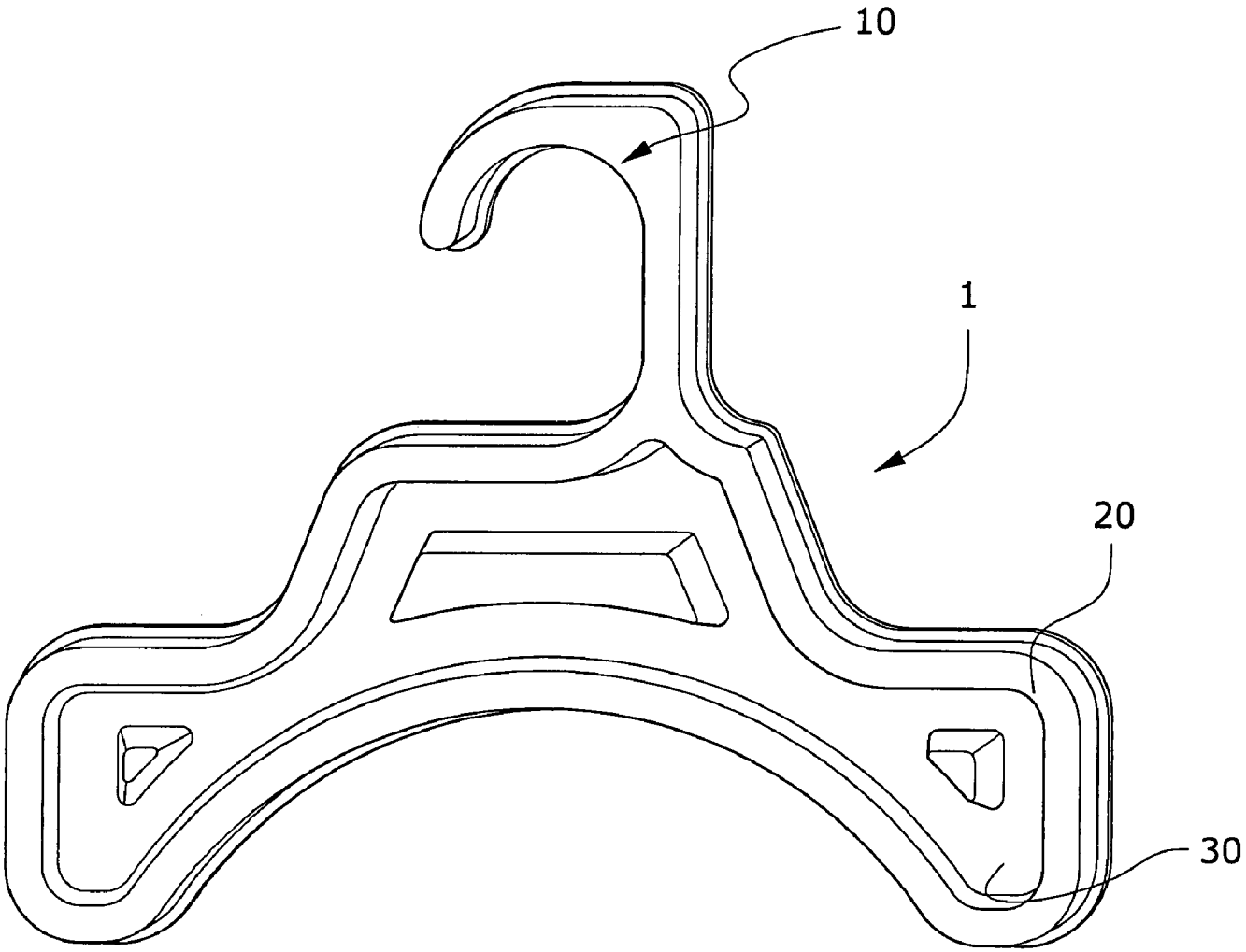
FIG. 2B is a perspective view of a second embodiment of the present invention.
Figures 3, 3A:
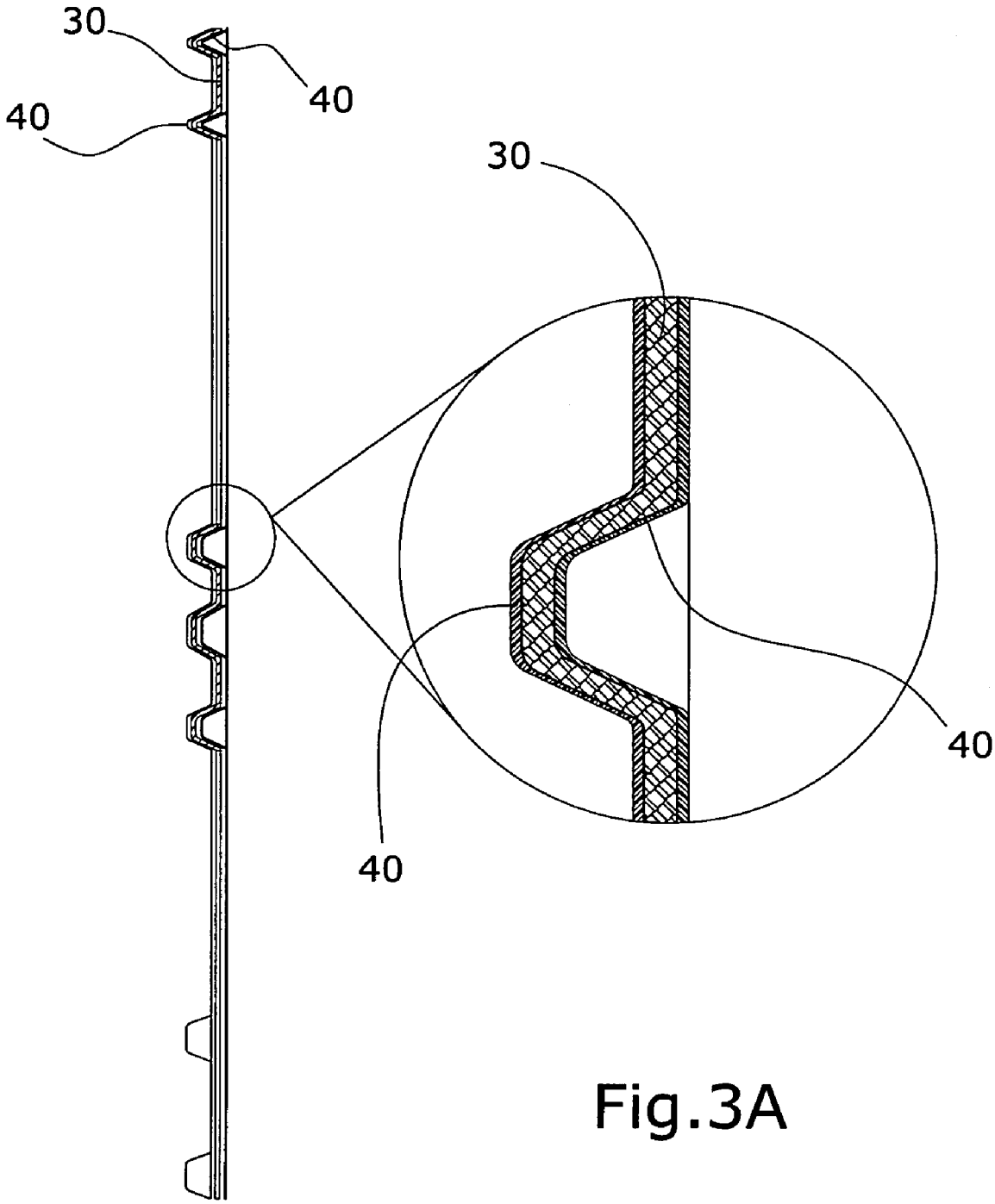
FIG. 3 is a cross-sectional view of the present invention.
FIG. 3A is an enlarged view of FIG. 3.

Referring to FIG. 2A, FIG. 2B, FIG. 3 and FIG. 3A, the present invention comprises a frame 1 made of raw paper pulp with a combination of one or more of bamboo, olive palm fiber, hemp and coconut shell. The frame 1 further includes a hook 10 and a supporting portion 20. The hook 10 is in a round hook shape. Several fortified indentations 30 are on the hook 10 and the supporting portion 20; a chemical solution 40 is spread on the surface of the whole structure, which can be water and steam-resist coating or anti-dissolution solution to fortify the surface strength.

Based on above description, the present invention has the features of non-pure paper pulp, several fortified indentation to fortify the structure and the whole surface has a chemical coating for better strength.

While a preferred embodiment of the invention has been shown and described in detail, it will be readily understood and appreciated that numerous omissions, changes and additions may be made without departing from the spirit and scope of the invention.

The invention claimed is:

1. A hanger for cloth or clothing, comprising:

a hook;

a supporting portion;

a plurality of fortified indentations on said hook and said supporting portion;

said hanger being made of raw plant fiber pulp including at least one of bamboo, olive palm fiber, hemp and coconut shell which is not usable for paper; and a chemical solution spread on a surface of the hanger;

wherein said chemical solution is at least one of a water and steam-resist coating, and an anti-dissolution solution.

* * * * *